US006393674B1

(12) United States Patent
Dolci

(10) Patent No.: US 6,393,674 B1
(45) Date of Patent: May 28, 2002

(54) CLOSURE DEVICE FOR CLOTHING, FOOTWEAR AND LUGGAGE ITEMS AND THE LIKE

(75) Inventor: Danilo Dolci, Camerano (IT)

(73) Assignee: Danilo Dolci S.R.L., Camerano (IT)

( * ) Notice: Subject to any disclaimer, the term of this patent is extended or adjusted under 35 U.S.C. 154(b) by 0 days.

(21) Appl. No.: 09/525,634

(22) Filed: Mar. 14, 2000

(30) Foreign Application Priority Data

Mar. 19, 1999 (IT) ..... MO99A0047

(51) Int. Cl.[7] ..... A44B 21/00; A44B 19/00

(52) U.S. Cl. ..... 24/437; 24/399; 24/400; 24/438

(58) Field of Search ..... 24/437, 438, 399, 24/400, 712.1, 712.2

(56) References Cited

U.S. PATENT DOCUMENTS

| | | | | | |
|---|---|---|---|---|---|
| ,791,332 | A | * | 5/1905 | Duval | 24/437 |
| 1,129,624 | A | * | 2/1915 | Battisti | 24/437 |
| 1,220,602 | A | * | 3/1917 | Campbell et al. | 24/437 |
| 1,408,563 | A | * | 3/1922 | Conger | 24/437 |
| 1,734,479 | A | | 11/1929 | Glidden | |
| 2,690,603 | A | | 10/1954 | Welteroth | |

FOREIGN PATENT DOCUMENTS

| | | |
|---|---|---|
| CH | 12 861 | 3/1897 |
| DE | 263 879 | 9/1912 |
| DE | 876 982 | 7/1949 |
| GB | 688 812 | 8/1951 |

* cited by examiner

*Primary Examiner*—Victor Sakran
(74) *Attorney, Agent, or Firm*—Guido Modiano; Albert Josif; Daniel O'Byrne

(57) ABSTRACT

A closure device for clothing, footwear and luggage items and the like is adapted to act on flattened and adjacent parts and comprises two elongated and parallel elements which have, at their outer lateral edges, a region for fixing to the respective parts to be joined and have, along the mutually facing inward lateral edges, a plurality of shaped portions for coupling to a movable element which is substantially as long as the elongated elements, has a plurality of complementarily shaped portions along its complementary edges, is provided with a grip in an upward region and can slide between the elongated elements in order to close the parts.

18 Claims, 6 Drawing Sheets

CLOSURE DEVICE FOR CLOTHING, FOOTWEAR AND LUGGAGE ITEMS AND THE LIKE

CROSS-REFERENCE TO RELATED APPLICATIONS

This application claims priority to Italian Application Serial No. M099A000047 filed Mar. 19, 1999, the disclosure of which is incorporated herein by reference.

BACKGROUND OF THE INVENTION

The present invention relates to a closure device for footwear and luggage items such as bags, suitcases and the like and for items of clothing such as, for example, trousers, jackets and clothes.

It is known to use buttons each comprising a solid rounded body, which protrudes from a surface made of fabric, leather or other materials for bags, cloths and shoes, and constitutes an element for temporarily joining the surface to another similar one provided with a buttonhole in which the button is inserted.

The two parts can also be joined by mutual engagement of two parts which are respectively fixed to the two surfaces to be joined and which are known, as a whole, as press-stud.

As an alternative to these closure devices, conventional zip fasteners are constituted by a double row of teeth made of metal or plastic which alternately interlock thanks to the force produced by actuating a slider.

These fasteners consist of a succession of a plurality of press-studs whose coupling, instead of being elastic and by pressure, is achieved thanks to the shape of the parts that mutually engage.

These closure systems are not devoid of drawbacks, including the fact that the press-studs do not allow rapid and perfectly hermetic closure, since they are mutually spaced and require individual closure operations, and zip fasteners tend to wear out and require lateral reinforcements to prevent the rows of teeth from separating from the respective surfaces due to the force applied by the slider.

Moreover, since the teeth must interlock with each other by forcing, they are subjected to continuous stress, break easily and in this case require complete replacement of the fastener.

SUMMARY OF THE INVENTION

The aim of the present invention is to eliminate the above-noted drawbacks of conventional types of zip fastener and buttons, providing a closure device for clothes, shoes, bags and the like which allows to achieve hermetic, rapid and effective closure, has an aesthetically valid appearance, does not require additional lateral reinforcements and is durable.

Within the scope of this technical aim, an object of the present invention is to achieve the above aim with a structure which is simple, relatively easy to provide in practice, safe in use, effective in operation and relatively low in cost.

This aim and this object are both achieved by the present closure device for clothing, footwear and luggage items and the like, which is adapted to act on flattened and adjacent parts, characterized in that it comprises two elongated and parallel elements having, at their outer lateral edges, a region for fixing to the respective parts to be joined and have, along the mutually facing inward lateral edges, a plurality of shaped portions for coupling to a movable element which is substantially as long as these elongated elements, has a plurality of complementarily shaped portions along its complementary edges, is provided with grip means in an upward region and can slide between said elongated elements in order to close the parts.

BRIEF DESCRIPTION OF THE DRAWINGS

Further characteristics and advantages of the present invention will become apparent from the following detailed description of a preferred but not exclusive embodiment of a closure device for clothes, shoes, bags and the like, illustrated only by way of non-limitative example in the accompanying drawings, wherein.

DESCRIPTION OF THE PREFERRED EMBODIMENTS

Figure 1:
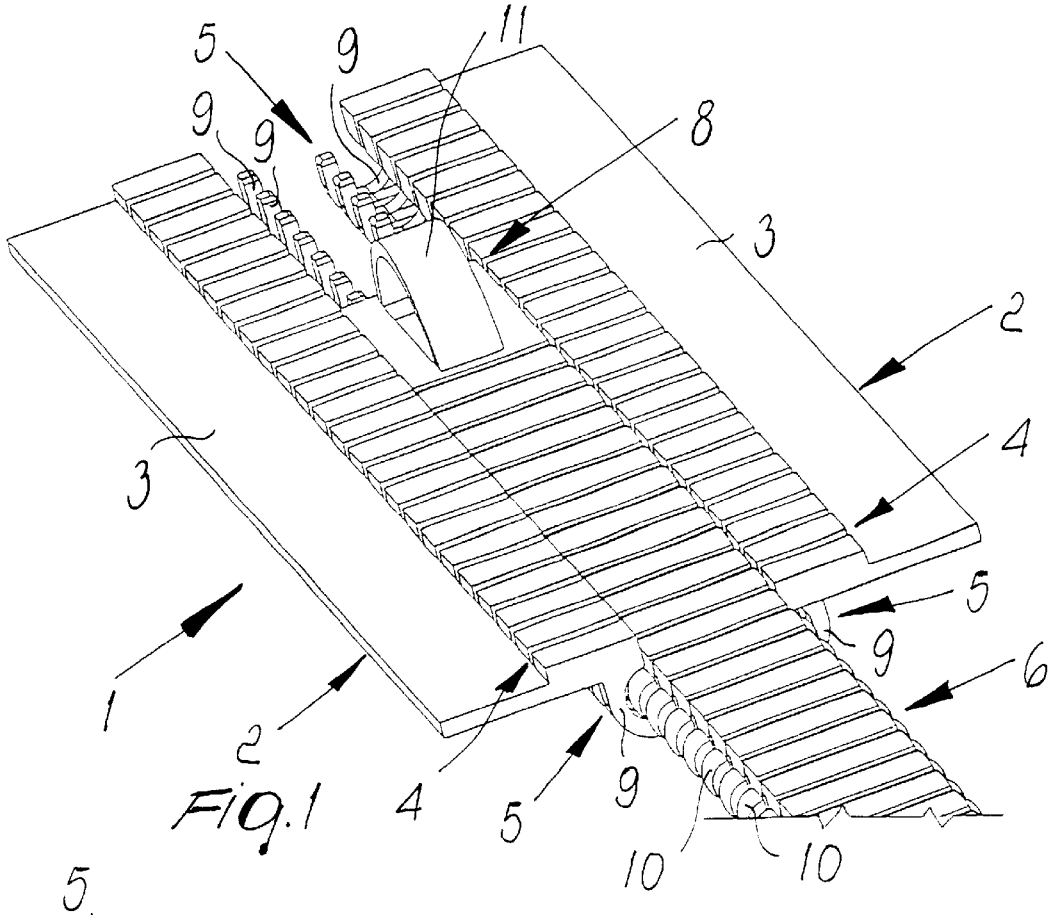
FIG. 1 is a top perspective view of a portion of a closure device for clothes, shoes, bags and the like according to the invention.
Figure 2:
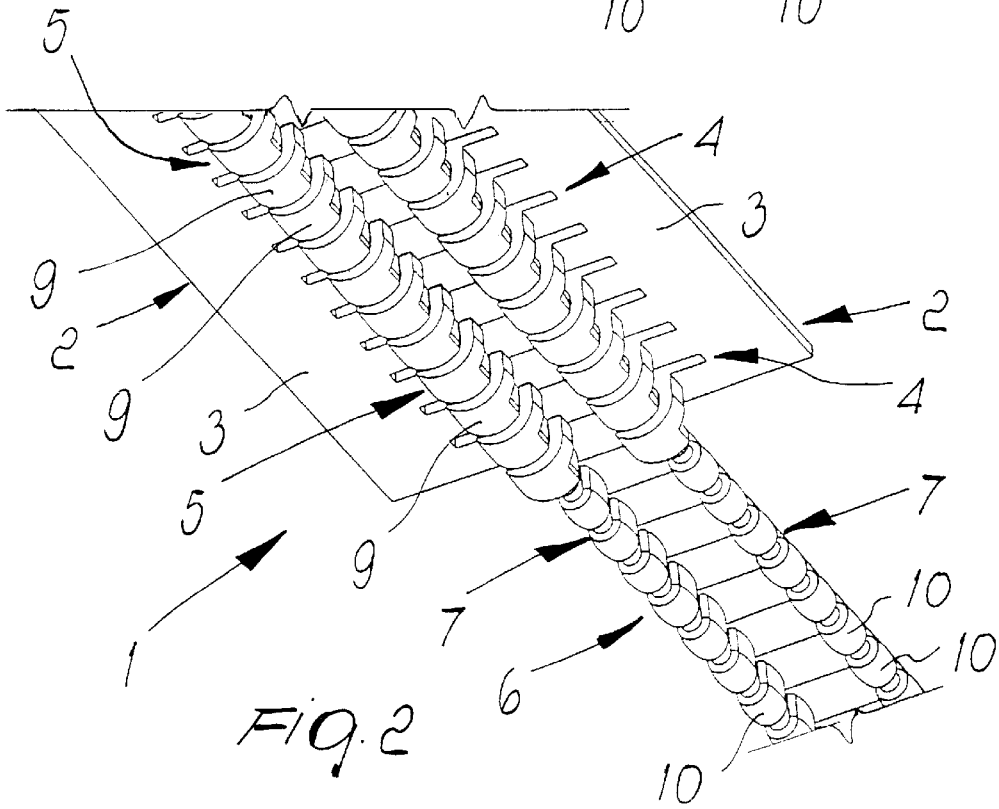
FIG. 2 is a bottom perspective view of a portion of the device according to the invention.
Figure 3:
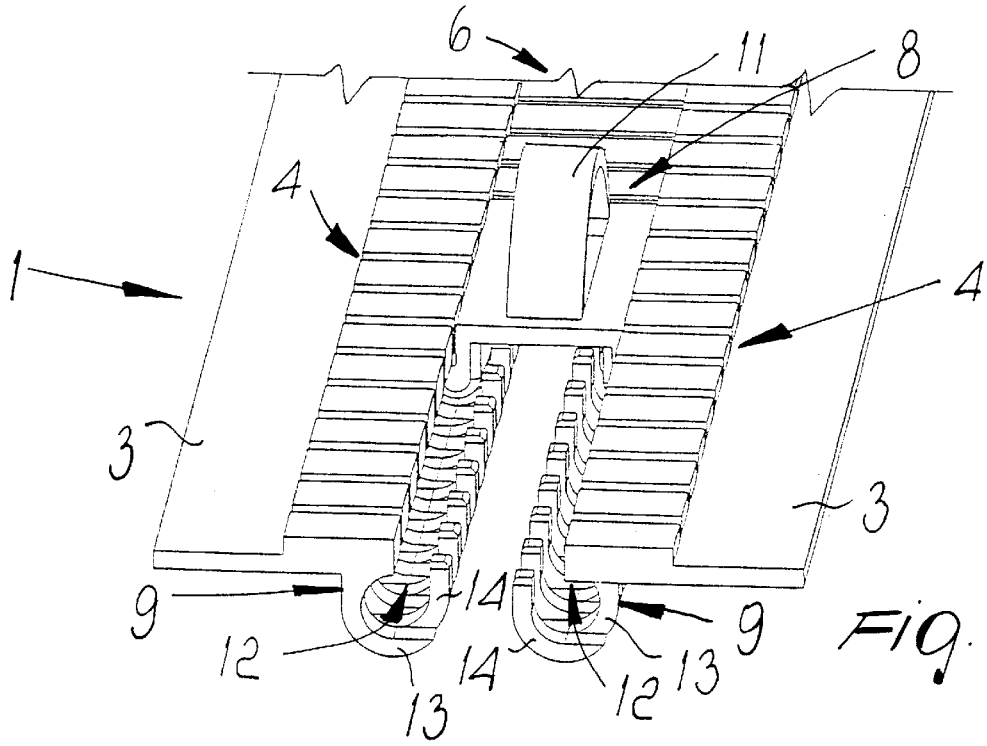
FIG. 3 is a perspective view of the front portion of the device according to the invention.
Figure 4:
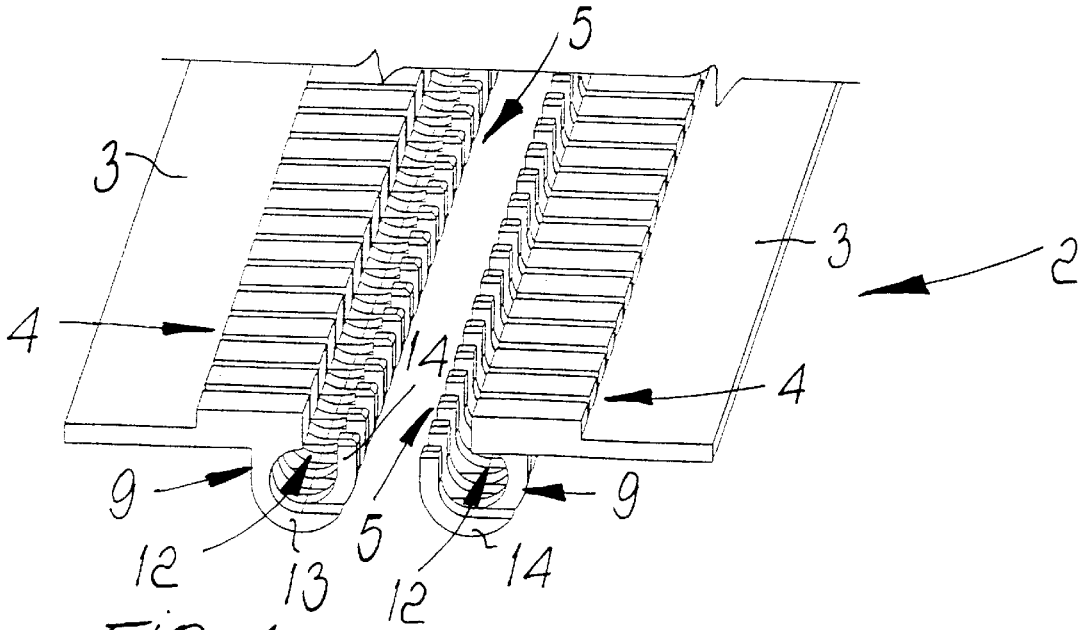
FIG. 4 is a perspective view of the front portion of the elongated elements of the device of FIG. 3.
Figure 5:
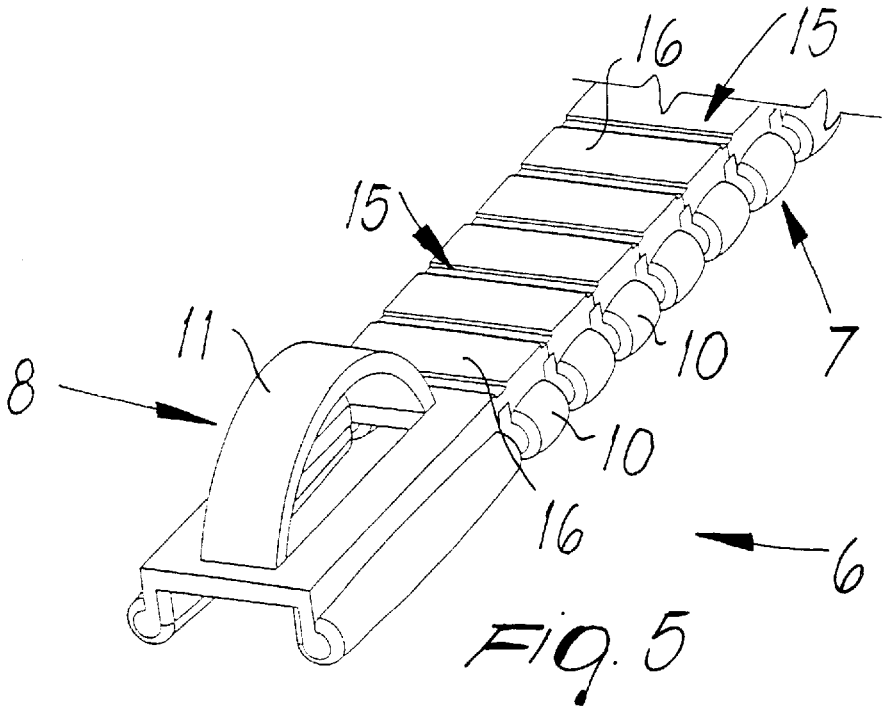
FIG. 5 is a perspective view of the front portion of the movable element of device of FIG. 3.
Figure 6:
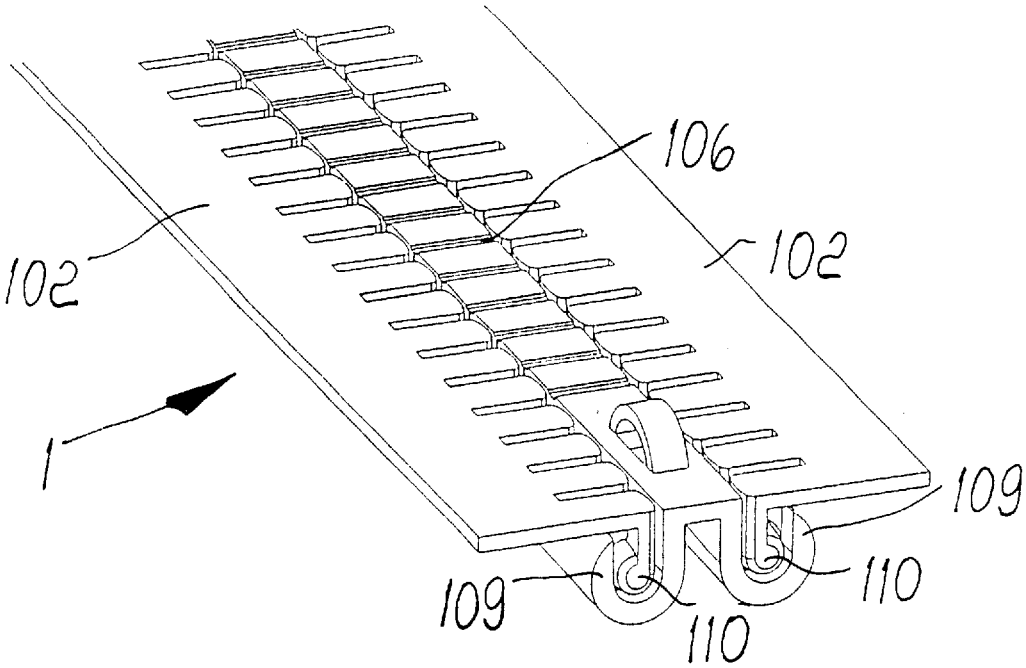
FIG. 6 is a top perspective view of a second embodiment of the device according to the invention.
Figure 7:
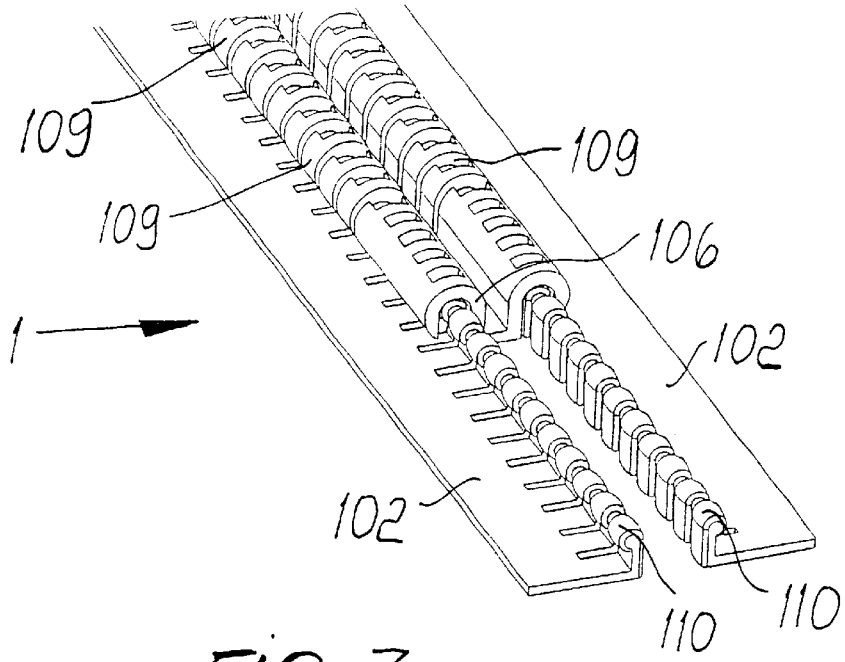
FIG. 7 is a bottom perspective view of the device of FIG. 6.
Figure 8:
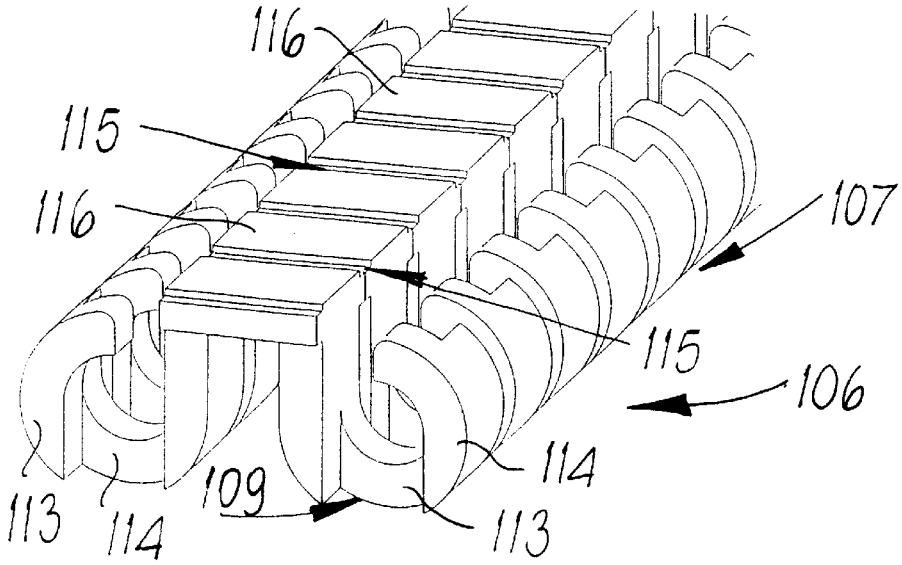
FIG. 8 is an enlarged-scale perspective view of the movable element of the device of FIG. 6.
Figure 9:
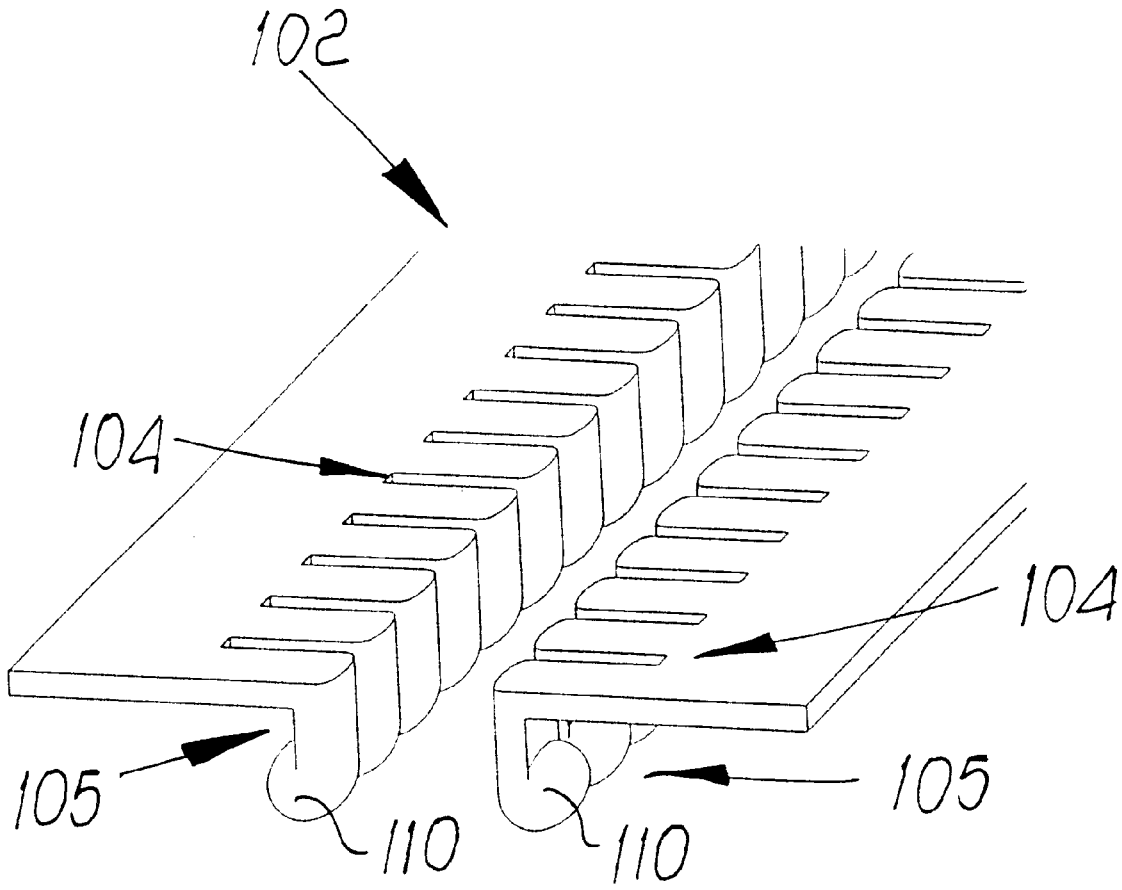
FIG. 9 is an enlarged-scale perspective view of the elongated elements of the device of FIG. 6.

With reference to the above figures, 1 generally designates a closure device which is adapted to act on flattened and adjacent parts of clothes, shoes, bags and the like.

The device 1 is constituted by two elongated and parallel elements 2 which have, at the outward lateral edges, a region 3 for fixing to the respective parts to be joined, which are not shown.

The inward lateral edges of the elongated elements 2 face each other and have a plurality of notches 4 which are alternated with shaped portions 5 for coupling to a movable element 6 which is substantially as long as the elements 2.

The movable element 6 has, along the complementary edges, a plurality of complementarily shaped portions 7, is provided with grip means 8 in an upward region and can slide between the two elongated elements 2 in order to allow the closure of the parts on which they are fixed.

In a preferred embodiment, the shaped portions 5 of the elements 2 are constituted by a plurality of arc-like teeth 9 which are aligned and separated with respect to each other, are distributed with constant spacing, and form a sort of guide for the sliding of the corresponding complementary edges of the movable element 6.

The complementarily shaped portions 7 of the movable element 6 are constituted by a plurality of substantially cylindrical pins 10 which are also distributed with constant spacing for coupling to the teeth 9 of the elongated elements 2.

The grip means 8 consist of a sort of small handle 11 for the sliding of the movable element 6 in both directions in the guides formed by the teeth 9 of the elongated elements 2.

Advantageously, the pins 10 have, at their ends, a flared surface which facilitates the mutual sliding of the elongated elements 2 and the movable element 6.

In order to prevent the pins 10 from protruding from the sliding seats 12 formed by the teeth 9, said teeth are arc-like and are constituted by two half-parts 13 and 14 which are arranged side by side and are alternated so that the seats cover more than 180°.

The exposed surfaces of the elongated elements 2 and of the movable element 6 have a plurality of transverse lightening notches 15 in order to increase, together with the notches 4 of the elongated elements 2, the flexibility of the entire device 1.

The notches 15 of the movable element 6 form, in turn, a plurality of transverse bridges 16, and the complementarily shaped portions 7 are rigidly supported at the lower ends of the bridges.

FIGS. 6, 7, 8 and 9 illustrate an alternative embodiment of the device 1: the numeral 102 designates the elongated elements and the numeral 106 designates the movable element, which are respectively provided with shaped portions 105 and with complementarily shaped portions 107.

In this case, the shaped portions 105, alternated with the notches 104, are constituted by the plurality of pins 110, while the complementarily shaped portions 107 are constituted by the teeth 109 for a mutual coupling which is similar to the embodiment of the device 1 of FIGS. from 1 to 5.

The movable element 106 comprises a succession of bridges 116 which are separated by the notches 115; the teeth 109 are rigidly fitted to the lower ends of the bridges and each tooth is formed by the two half-parts 113 and 114.

Figure 10:
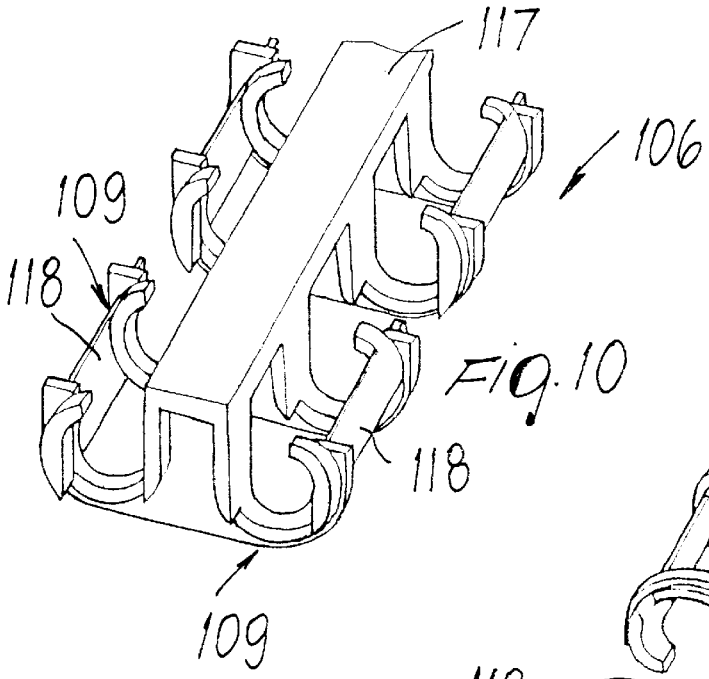
FIG. 10 is top perspective view of a portion of a further embodiment of the movable element of the device of FIG. 6.
Figure 11:
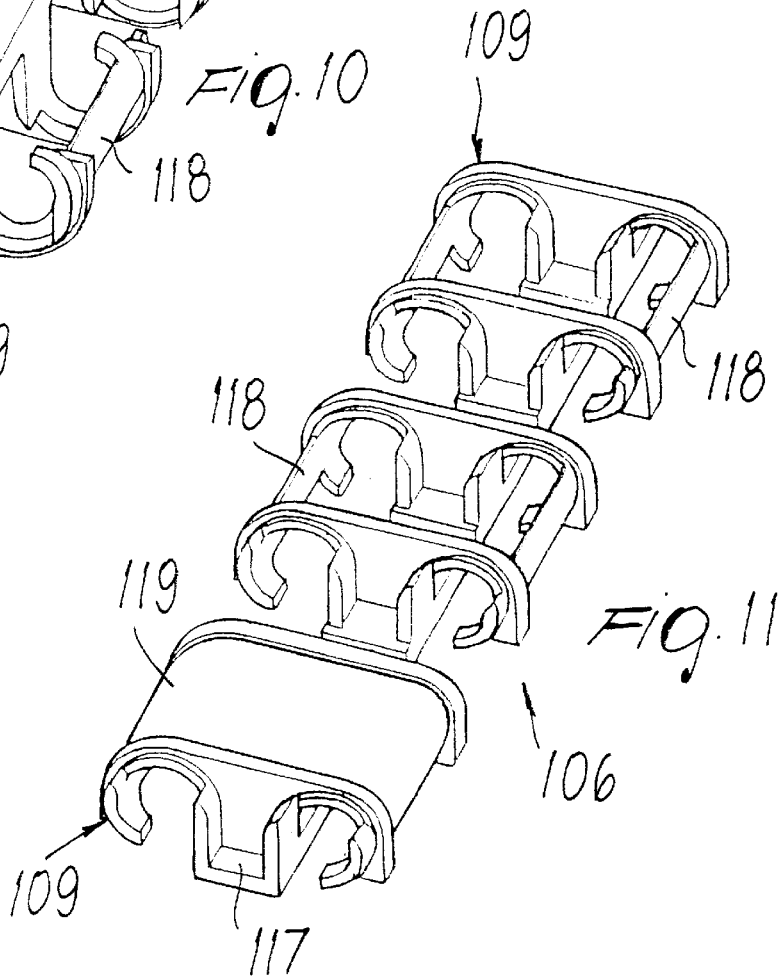
FIG. 11 is a bottom perspective view of the portion of the movable element of FIG. 10, provided with a stiffening insert.
Figure 12:
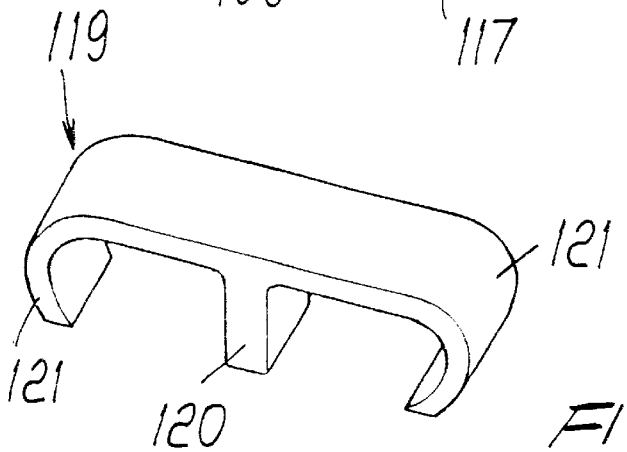
FIG. 12 is an enlarged-scale perspective view of a stiffening insert of the movable element of FIG. 10.

Advantageously, the movable element 106 can have an exposed surface 117 which is continuous and devoid of notches (see FIG. 10), so as to allow optional screen-printed decorations or the like which are adapted to improve its aesthetic appearance.

The teeth 109 of each complementarily shaped edge are further joined in pairs by means of respective longitudinal portions of material 118 which are rigidly coupled thereto. In order to increase the rigidity of the movable element 106, there are additional inserts 119 which can be inserted by interlocking between two teeth 109 which are adjacent and mutually joined.

In particular, each insert 119 is constituted by a middle portion 120, which can be inserted at the rear of the exposed surface 117, and by two lateral portions 121 which are mutually symmetrical and form a sort of arc-like wings which rest on the portions 118.

The device 1 according to the invention can be made of a material such as plastic or metal and the like and others according to the application requirements.

In practice it has been observed that the above-described invention achieves the intended aim and object.

The invention thus conceived is susceptible of numerous modifications and variations, all of which are within the scope of the inventive concept.

All the details may further be replaced with other technically equivalent ones.

In practice, the materials used, as well as the shapes and the dimensions, may be any according to requirements without thereby abandoning the scope of the protection of the appended claims.

The disclosures in Italian Patent Application No. M099A000047 from which this application claims priority are incorporated herein by reference.

What is claimed is:

1. A closure device for clothing, footwear and luggage items adapted to act on flattened and adjacent parts of said items, comprising:

two elongated and parallel elements having each at an outer lateral edge a region for fixing to a respective one of said parts to be joined;

a plurality of shaped portions constituted by a plurality of substantially cylindrical pins which are distributed with constant spacing along mutually facing inward lateral edges of said elongated elements;

a movable element being substantially as long as said elongated elements;

a plurality of complementarily shaped portions provided along complementary edges of said movable element, which are coupleable to said shaped portions; and a grip means located in an upward region of the movable element; and wherein said movable element is slidingly movable between said elongated elements with said plurality of complementarily shaped portions being guided along said plurality of substantially cylindrical pins forming respective guides for guiding sliding of a corresponding one of said complementary edges of said movable element in order to close said parts.

2. The device of claim 1, wherein said complementarily shaped portions are constituted by a plurality of mutually aligned and separated arc-like teeth, said teeth being distributed with constant spacing for sliding coupling to said cylindrical pins of said elongated elements.

3. The device of claim 2, wherein said cylindrical pins are chamfered at opposite ends thereof in order to facilitate sliding with respect to each other of said elongated elements and said movable element.

4. The device of claim 2, wherein said aligned teeth form an arc-like seat for accommodating sliding motion of said pins, said teeth being arcuated for more than 180°.

5. The device of claim 4, wherein said teeth are constituted by two half-parts which are arranged side by side, are alternated and form said arc-like seat.

6. The device of claim 2, wherein said movable element has, at an exposed surface thereof, a plurality of transverse lightening notches which increase flexibility of the movable element and form a plurality of transverse bridges, said complementarily shaped portions being rigidly supported at lower ends of said bridges.

7. The device of claim 6, wherein said elongated elements have, at inward edges thereof, a plurality of notches which are distributed alternately with said shaped portions, and increase flexibility of said elongated elements.

8. The device of claim 7, wherein the teeth of each complementary edge of the movable element are joined in pairs by way of respective portions of longitudinal material which are rigidly coupled thereto.

9. The device of claim 8, comprising a corresponding stiffening insert, insertable by interlocking between two adjacent and mutually joined teeth.

10. The device of claim 9, wherein each said insert comprises a middle portion, which can be inserted between two adjacent teeth at the rear of the exposed surface of the movable element, and two lateral portions, which are arranged symmetrically and form arc-like wings which rest on corresponding portions of said longitudinal material which are rigidly coupled to said teeth.

11. The device of claim 1, wherein said grip means comprises a handle for driving in sliding motion said movable element in both directions.

12. A closure device for clothing, footwear and luggage items adapted to act on flattened and adjacent parts of said items, comprising:

two elongated and parallel elements having each at an outer lateral edge a region for fixing to a respective one of said parts to be joined;

a plurality of shaped portions constituted by a plurality of mutually aligned and separated arc-like teeth which are distributed with constant spacing along mutually facing inward lateral edges of said elongated elements;

a movable element being substantially as long as said elongated elements;

a plurality of complementarily shaped portions constituted by a plurality of substantially cylindrical pins distributed with constant spacing along complementary edges of said movable element and being couplable to said plurality of arc-like teeth of said elongated elements; and a grip means located in an upward region of the movable element; and wherein said movable element is slidingly movable between said elongated elements with said plurality of cylindrical pins being guided in said plurality of arc-like teeth forming guiding paths for guiding sliding of corresponding complementary edges of said movable element in order to close said parts.

13. The device of claim 12, wherein said grip means comprises a handle for driving in sliding motion said movable element in both directions.

14. The device of claim 12, wherein said cylindrical pins are chamfered at opposite ends thereof in order to facilitate sliding with respect to each other of said elongated elements and said movable element.

15. The device of claim 12, wherein said aligned teeth form an arc-like seat for accommodating sliding motion of said pins, said teeth being arcuated for more than 180°.

16. The device of claim 15, wherein said teeth are constituted by two half-parts which are arranged side by side, are alternated and form said arc-like seat.

17. The device of claim 12, wherein said movable element has, at an exposed surface thereof, a plurality of transverse lightening notches which increase flexibility of the movable element and form a plurality of transverse bridges, said complementarily shaped portions being rigidly supported at lower ends of said bridges.

18. The device of claim 17, wherein said elongated elements have, at inward edges thereof, a plurality of notches which are distributed alternately with said shaped portions, and increase flexibility of said elongated elements.

* * * * *